US011262039B1

(12) United States Patent
Green

(10) Patent No.: US 11,262,039 B1
(45) Date of Patent: Mar. 1, 2022

(54) SOLAR LIGHT FIXTURE ASSEMBLY

(71) Applicant: Wayne Green, Goose Creek, SC (US)

(72) Inventor: Wayne Green, Goose Creek, SC (US)

( * ) Notice: Subject to any disclaimer, the term of this patent is extended or adjusted under 35 U.S.C. 154(b) by 0 days.

(21) Appl. No.: 17/193,964

(22) Filed: Mar. 5, 2021

(51) Int. Cl.

| | |
|---|---|
| ***F21S 9/03*** | (2006.01) |
| ***F21V 23/04*** | (2006.01) |
| ***F21V 3/00*** | (2015.01) |
| ***F21V 17/12*** | (2006.01) |
| ***F21Y 115/10*** | (2016.01) |
| ***F21V 3/06*** | (2018.01) |
| ***G09F 7/18*** | (2006.01) |
| ***G09F 13/02*** | (2006.01) |
| ***F21Y 105/10*** | (2016.01) |
| ***G09F 13/04*** | (2006.01) |

(52) U.S. Cl.
CPC ..... *F21S 9/037* (2013.01); *F21V 3/00* (2013.01); *F21V 17/12* (2013.01); *F21V 23/0464* (2013.01); *F21V 3/0615* (2018.02); *F21Y 2105/10* (2016.08); *F21Y 2115/10* (2016.08); *G09F 13/02* (2013.01); *G09F 13/0431* (2021.05); *G09F 2007/1804* (2013.01); *G09F 2007/1873* (2013.01)

(58) Field of Classification Search
CPC ..... F21V 3/0615; G09F 2007/1804; G09F 2007/1817; G09F 2007/1847; G09F 2007/1873; G09F 13/0431
USPC ..... 40/607.09
See application file for complete search history.

(56) References Cited

U.S. PATENT DOCUMENTS

| | | | | |
|---|---|---|---|---|
| D378,143 | S * | 2/1997 | Kollins | D26/60 |
| 7,654,684 | B1 * | 2/2010 | Wight | G09F 13/02 362/183 |
| 9,470,385 | B1 * | 10/2016 | Ploucher | B63B 59/02 |
| 2006/0050528 | A1 * | 3/2006 | Lyons | G09F 13/02 362/559 |
| 2006/0130382 | A1 * | 6/2006 | Howell | G09F 27/007 40/607.09 |
| 2006/0274521 | A1 * | 12/2006 | Ullrich | G09F 27/007 362/159 |
| 2007/0017131 | A1 * | 1/2007 | Visotcky | G09F 13/02 40/559 |
| 2007/0236924 | A1 * | 10/2007 | Personius | G09F 7/22 362/183 |
| 2014/0211459 | A1 * | 7/2014 | Toner | E04H 12/32 362/183 |

* cited by examiner

*Primary Examiner* — Alan B Cariaso
(74) *Attorney, Agent, or Firm* — Lamon Patent Services; Cynthia S. Lamon

(57) ABSTRACT

A sign board lighting assembly is provided and includes a pair of solar powered lighting modules positionally opposed at front and rear sides of a sign bar adapted by hardware to hang the sign board, each lighting module including a housing supporting a solar collection array, an energy storage medium, an illumination grid, connected together by electrical trace or wire, and an optical switching element connected to the tracing or wiring between the energy storage medium and the illumination grid, the optical switching element operable according to an optically detected threshold level of ambient natural light to open and to close a circuit in the tracing or wiring between the energy storage medium and the illumination grid.

11 Claims, 6 Drawing Sheets

SOLAR LIGHT FIXTURE ASSEMBLY

CROSS-REFERENCE TO RELATED DOCUMENTS

BACKGROUND OF THE INVENTION

1. Field of the Invention

The present invention is in the field of advertising and pertains more particularly to methods and apparatus for solar powering outdoor lighting arrangements for outdoor sign board advertising.

2. Discussion of the State of the Art

In the art of advertising, sign boards are available to carry advertising and may be erected or hung from various structures or fixtures placed outside for advertising to people driving by the sign board. Examples include hanging sign boards, mounted sign boards, or propped up sign boards placed in residential areas including properties and commercial areas including properties. Advertising on sign boards may relate to the availability or sale of property or land, advertising for businesses, church announcement boards, bar or club entertainment boards, school messaging boards, and so on.

In some cases, sign boards are hung to swing from a horizontally erected rail or bar. Other sign boards are propped up on easel constructions, still others are mounted on a vertical surface such as on the side of a building or on a roadside vertical construction where the signboard is a larger billboard. Sign board displays are intended to target people with a message or one or more advertisements while the people are walking, driving, or otherwise passing by the location of the sign board.

A challenge in the art of sign board advertising is that while these sign board displays are typically clearly visible and legible when viewed in the day light hours, as the day wanes into dusk the displays becomes less and less visible. As the dusk turns to night, the sign board displays can only be seen if a source of light is provided and directed to shine against the sign boards like headlights or one or more mounted spotlights or provided within the board or behind the advertising illuminating it.

The above-described problem with current sign board displays that are not lighted at night reduces the number of people who will see the advertisement on those sign boards. The sign boards that have local lighting sources are more expensive to maintain with wiring, battery drain, replacing illumination elements, or just the cost of the electricity to keep them illuminated.

Therefore, what is clearly needed is a solar powered sign board lighting system that reduces or eliminates the problems with current sign board advertising.

BRIEF SUMMARY OF THE INVENTION

According to an embodiment of the present invention, a sign board lighting assembly is provided and includes a pair of solar powered lighting modules positionally opposed at front and rear sides of a sign bar adapted by hardware to hang the sign board, each lighting module including a housing supporting a solar collection array, an energy storage medium, an illumination grid, connected together by electrical trace or wire, and an optical switching element connected to the tracing or wiring between the energy storage medium and the illumination grid, the optical switching element operable according to an optically detected threshold level of ambient natural light to open and to close a circuit in the tracing or wiring between the energy storage medium and the illumination grid.

In one embodiment, the positionally opposed lighting modules are each connected by screws to a center dowel placed into an opening in the side bar, the interfacing ends of the lighting module housings pressing against the opposing sides of the sign bar. In one embodiment, the sign bar is supported by at least one vertical post and extends orthogonally from the vertical post or posts. In one embodiment, the signpost is connected to the bottom end of the sign bar by eye bolts screwed into the bottom of the sign bar, the sign board hanging from the hook portions of the eye bolts.

In one embodiment, the solar collection array is a solar panel. In one embodiment, the energy storage medium is a battery pack. In one embodiment, the illumination grid is a grid of light emitting diodes (LED). In one embodiment, the solar collection array and the illumination grid are held parallel in separate planes by the housing. In another embodiment, the solar collection array and or the illumination grid are held at angles offset from 180 degrees. In a variation of this embodiment, the solar collation array and or the illumination grid are angularly adjustable away from 180 degrees. In one embodiment, the solar powered lighting modules each further include a pane of light diffusing glass installed over the illumination grid.

DETAILED DESCRIPTION OF THE INVENTION

In various embodiments described in enabling detail herein, the inventor provides a unique system for powering advertising sign board displays using solar lighting modules. It is the goal of the present invention to provide a solar means for powering illumination elements of a lighted sign board display. It is a further goal of the present invention to reduce or eliminate electricity costs for maintaining a lighted sign board display. It is a further goal of the invention to reduce maintenance costs to maintain lighted sign board displays. The present invention is described using the following examples, which may describe more than one relevant embodiment falling within the scope of the invention.

Figure 1:
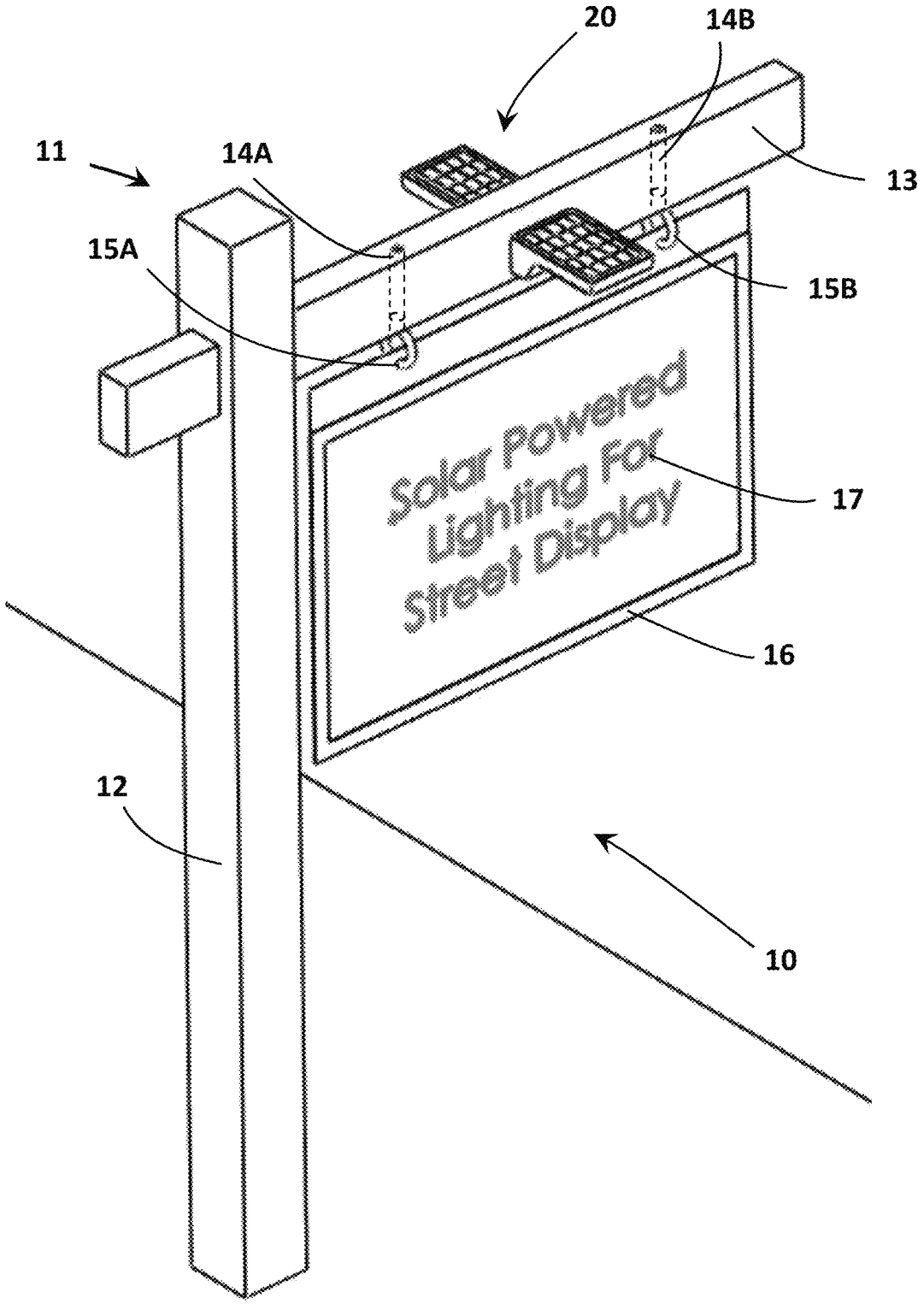
FIG. 1 is a perspective view of a solar powered sign board display attached to a horizontal bar according to an embodiment of the present invention.

FIG. 1 is a perspective view of a solar powered sign board display 10 attached to a horizontal bar according to an embodiment of the present invention. Sign board display 10 includes a rectangular sign board 16 having advertising or messaging content 17 printed or otherwise arranged thereon the vertical surface area of the board visible to passersby. In one embodiment, both broad sides of sign board 16 include advertising or messaging content 17. Sign board 16 may be fabricated of wood, metal, plastic, or a combination of those materials and may be a solid board, a layered board, or a thin box structure having a hollowed inside to reduce weight.

A vertical construction 11 is provided in the form of a signpost and may be referred to hereinafter as signpost 11. Sign post 11 includes a vertical post 12 set into the ground and includes a sign bar 13 protruding from vertical post 12 and extending some distance out from post 12 in an orthogonal relationship to post 12. Vertical post 12 and sign bar 13 may be fabricated of wood, metal, plastic, or a combination of those materials without departing from the spirit and scope of the invention.

In this embodiment, sign bar 13 includes two through openings 14A and 14B placed vertically and spaced apart to accept threaded eye bolts 15A and 15B, which may be threaded into, or pass through the openings 14A and 14B from the bottom end of sign board 16. The eye bolts passing through 14A and 14B enable additional accessories to be attached. In other embodiments, sign board 16 may be hung by cables, mounted to sign bar 13 using brackets, or other hardware without departing from the spirit and scope of the present invention. Moreover, the architecture of vertical construction 11 may vary considerably from what is depicted in FIG. 1 without departing from the spirit and scope of the present invention.

A solar powered lighting assembly 20 is provided and is installed on sign bar 13 roughly at center of the bar just over the center of sign board 16. Lighting assembly 20 may include solar collecting elements, power storing elements, and illumination elements that rely on the stored solar energy to illuminate, in this case, the front side and the rear side of sign board 16. Such elements are introduced and described in detail later in this specification. In this embodiment, lighting assembly 20 collects solar energy through a solar collection mechanism and stores that energy in a solar battery pack including a single battery or a or a set of batteries. An ambient light detecting power switch (not illustrated) may be provided to turn on the illuminating elements when the ambient lighting is low enough that illumination is deemed necessary to enable people to read content 17 on either side of signpost 16.

Figure 2:
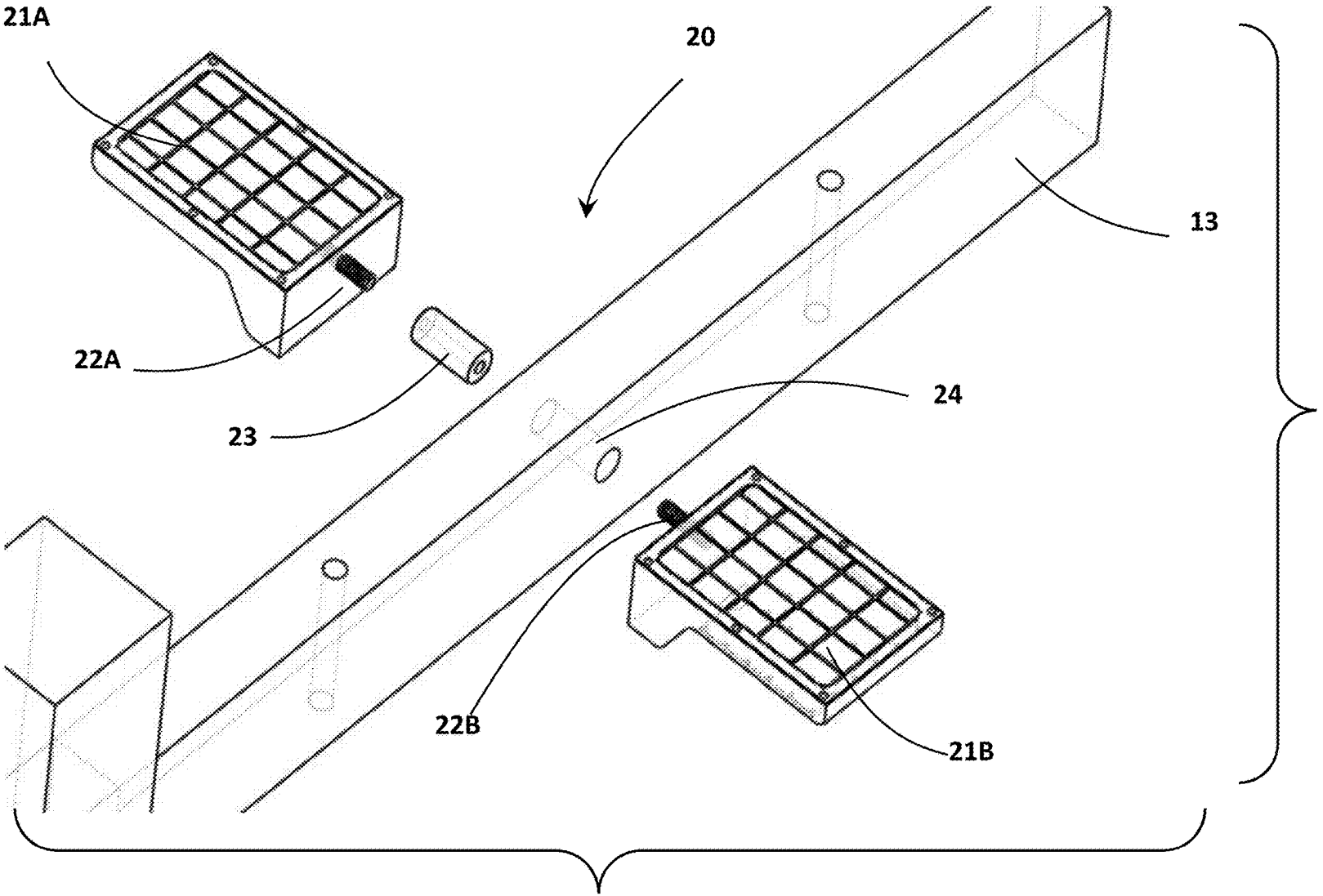
FIG. 2 is an enlarged perspective view of the solar lighting assembly of the sign board display of FIG. 1.

FIG. 2 is an enlarged exploded view of solar lighting assembly 20 of the sign board display of FIG. 1. Solar lighting assembly 20 includes a solar illumination module 21A and an opposing identical solar illumination module 21B, the modules being independently serviceable and replaceable. In this embodiment, sign bar 13 includes a through opening 24 placed through sign bar 13 roughly at center of the bar, the through opening 24 extending through the bar orthogonally breaking out at both sides. Opening 24 has an inside diameter held just large enough to accept, with reasonable force of insertion, the outside diameter of a dowel pin 23 of a length roughly equal to the thickness dimension of rectangular sign bar 13. Dowel pin 23 may be fabricated of wood, metal, for example aluminum or a polymer-based material like plastic.

Illumination modules 21A and 21B each have a single screw threaded thereto at one end interfacing sign bar 13. Lighting module 21A has screw 22A while lighting module 21B includes screw 22B. Screws 22A and 22B extend out from a center position on the bar-interfacing walls of the lighting module housings wherein in one embodiment, screws 22A and 22B are fixed to the lighting modules by crimping, pinning, or by welding in place. In another embodiment, screws 22A and 22B are assembled components that are used to mount the light modules to sign bar 13 and are inserted through the interfacing walls of the lighting modules and are not necessarily fixed to the modules.

In this embodiment, dowel pin 23 includes a through opening extending longitudinally there through, the opening placed roughly at center of the dowel pin and aligned with longitudinal center of the pin. In one embodiment, the opening through dowel pin 23 is female threaded to accept the male external threading of screws 22A and 22B. The overall length of screws 22A and 22B are held to a dimension that is shorter than one half of the length of the opening placed through dowel pin 23. In this way, the free ends of screws 22A and 22B maintain a distance between them so that each lighting module 21A and 21B may be fixedly clamped surface-to-surface to the sign bar 13 with enough force to hold the assembly tight on the bar.

In this embodiment, a user may insert dowel pin 23 into opening 24 through one side or the other side of the bar. Each lighting module 21A and 21B may be threaded into the opening of dowel pin 23 to the full depth of screws 22A and 22B until the assembly 20 is secured tightly to sign bar 13.

Figure 3:
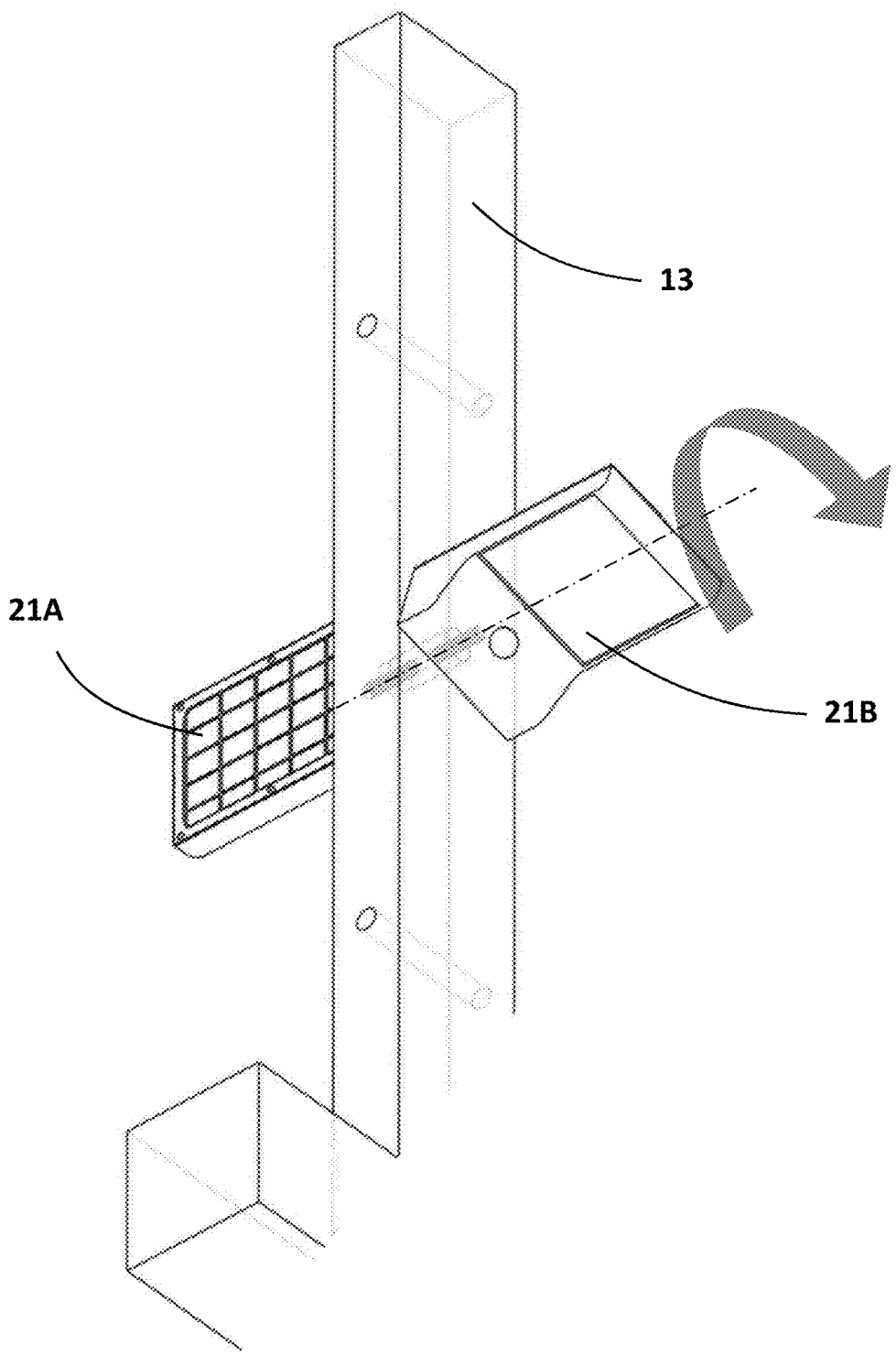
FIG. 3 is an enlarged perspective view of the solar lighting assembly of FIG. 2 being installed on the horizontal bar of FIG. 1.

FIG. 3 is an enlarged perspective view of solar lighting assembly 20 of FIG. 2 being installed on the horizontal bar of FIG. 1. In this view the dowel pin is in place in bar 13 and lighting module 21A is threaded tightly into position against bar 13, while lighting module 21B is in the process of being threaded against bar 13. In this example, the screws are fixed to the lighting modules. The modules are threaded into the dowel pin at both sides by rotating each module in a clockwise direction to advance the screw threads into the threaded opening in the dowel pin.

The lighting module 21B is depicted turning clockwise in this example, bringing the modules closer to each other utilizing the full length of the screws. When the lighting modules clamp surface-to-surface at the horizontal bar 13 and they are rigidly in place and in position to illuminate sign board 16. It is noted that to secure the assembly, a gap remains between the free ends of the screws inside the dowel pin.

Figure 4:
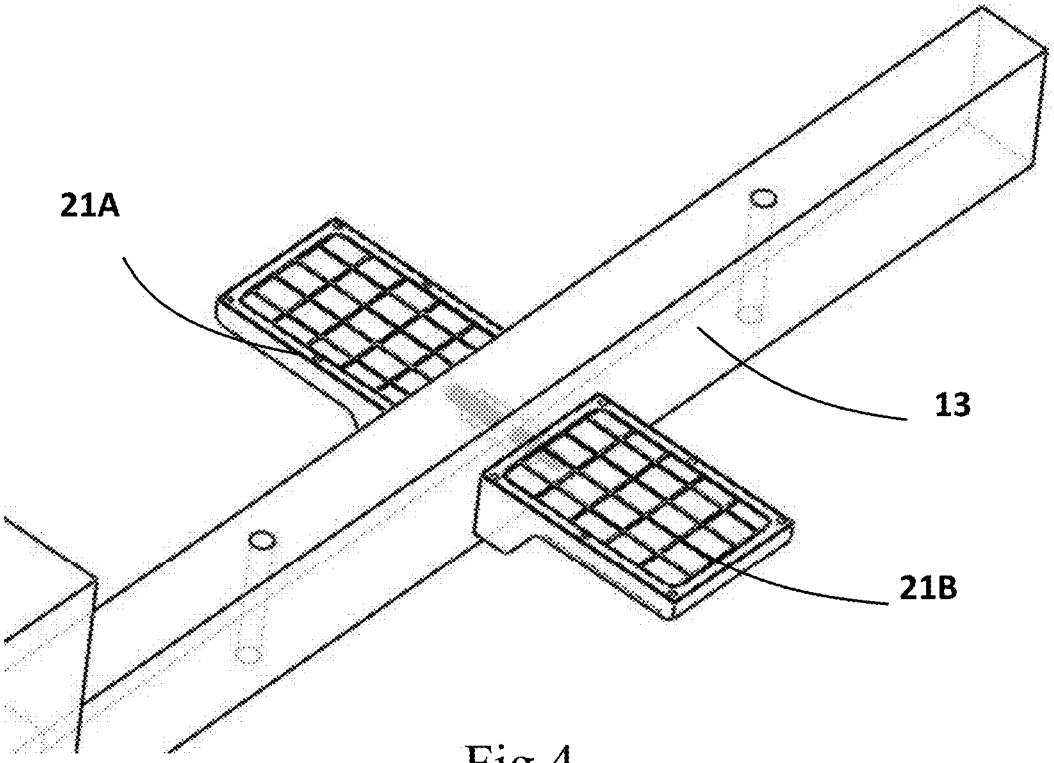
FIG. 4 is an enlarged perspective view of the solar lighting assembly of FIG. 3 after installation.

FIG. 4 is an enlarged perspective view of solar lighting assembly 20 of FIG. 3 after installation. In this view lighting assembly 20 is fully installed through sign bar 13. Lighting modules 21A and 21B of the assembly are brought to a position to collect solar energy and illuminate the sign board. Typically, that requires the solar collection elements to face up and the illumination elements to face down in the embodiment of a hanging sign board where the illumination elements are over the board at both sides of the board face downward, the light emitted diffusing over both content supporting sides of the sign board. There may be other angular arrangements than the one depicted incorporated into lighting modules 21A and 21B without departing from the spirit and scope of the present invention.

Figure 5:
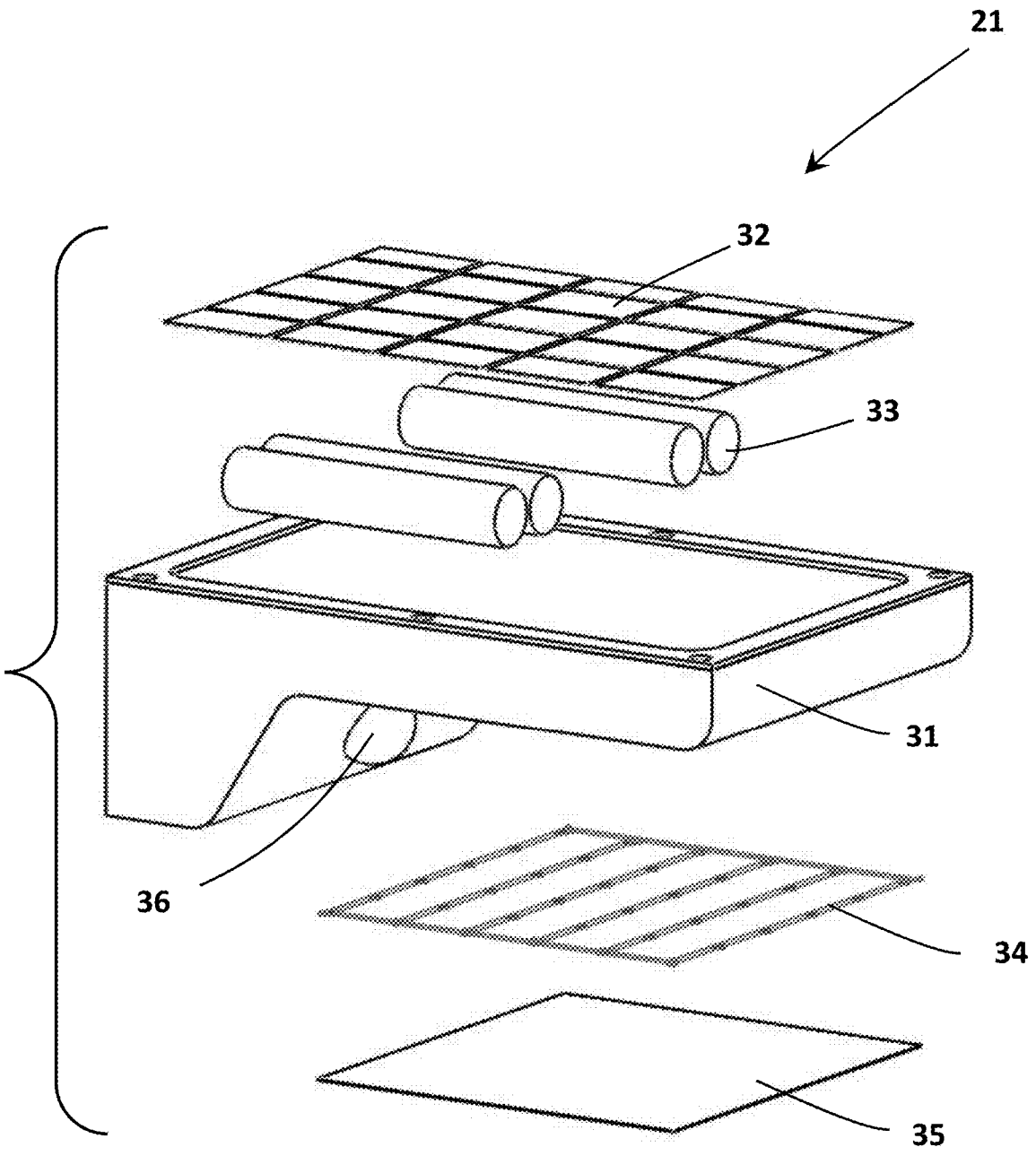
FIG. 5 is an exploded view of a lighting module of the solar lighting assembly of FIG. 4 depicting atomic elements of the lighting module.

FIG. 5 is an exploded view of lighting module 21A or 21B of the solar lighting assembly 20 of FIG. 1 depicting atomic elements of the lighting module. Solar lighting assembly 20 converts solar energy into electrical energy to power illumination elements. The modules each have a solar energy collection element such as a solar panel 32 positioned at top of a light module housing or case 31. Housing 31 may be molded of plastic or another non-conductive or shock resistant material. This electrical energy is stored in a battery cell pack or set of batteries 33. During the daylight, the battery pack 33 is charging, at least until fully charged.

In this embodiment, the illumination elements are light emitting diodes (LED) arranged into a rectangular grid 34 connected to battery pack 33 functioning as the power source for illuminating the grids. The light rays emitted from grid 34 diffuse out through a glass shield 35 and illuminates both sides of an under hanging sign board such as sign board 16 referenced further above. In one embodiment, the glass may be acrylic, translucent plastic or other translucent polymer. In this embodiment, a photo electric switch 36 is provided to power on or off the lighting modules 21A and 21B using a breaker type (open/close) circuit to connect to and disconnect the modules from the power source.

Switch 36 is disposed at a position in the lower portion of module housing 31 and detects a threshold level of ambient light to automatically power on illumination and power off illumination. When the ambiance is bright the photoelectric switch 36 disconnects the battery 33 from the LED grid 34 and turns the LEDs off and the switch 36 turns the LEDs on during dark or low level ambient light conditions. At a level above the ambient light threshold, the switch 36 disconnects (breaks the circuit) between the batter pack 33 and the LED grids 34. At a level equal to or below the threshold, switch 36 connects (closes the circuit) between battery pack 33 and LED grids 34.

In one embodiment, solar panels 32 and LED grid 34 are spaced vertically with the solar panel on top and the illumination grid on bottom and wherein the components are held substantially parallel and horizontal (180 degrees). However, in one embodiment one or the other, or both components may be offset by an angle from horizontal, for example, the illumination grids angled more toward the sign board or the solar panel angled more toward the zenith of the path of the sun over the course of the day. In one embodiment, the solar panels and illumination grids are angularly adjustable away from 180 degrees.

Figure 6:
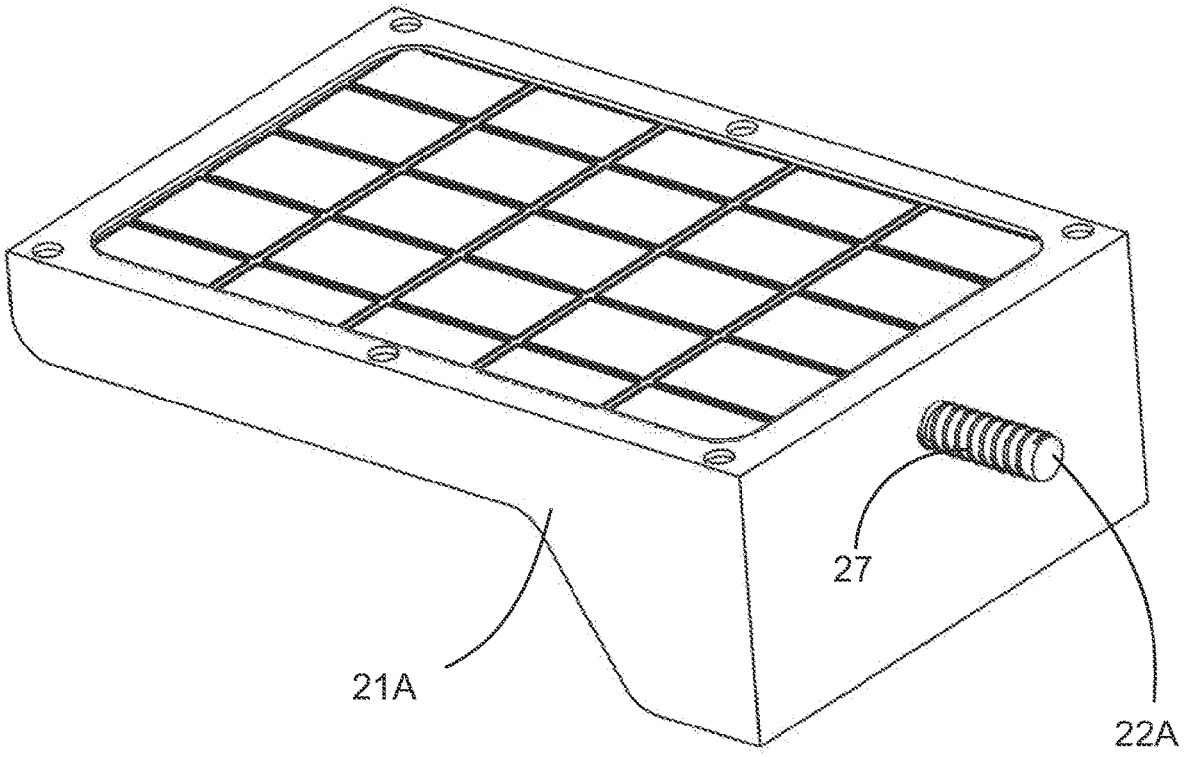
FIG. 6 is a perspective view of the lighting module.

FIG. 6 is a perspective view of the lighting module. This embodiment clearly shows threads 27 on screw 22A. These threads 27 engage the dowel pin at both sides by rotating each module in a clockwise direction to advance the screw threads 27 into the threaded opening in the dowel pin.

It will be apparent with skill in the art that the sign board lighting display of the present invention may be provided using some or all the elements described herein. The arrangement of elements and functionality thereof relative to the sign board lighting display of the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. A sign board lighting assembly comprising:

a pair of solar powered lighting modules positionally opposed at front and rear sides of a sign bar adapted by hardware to hang a sign board, each lighting module including a housing supporting a solar collection array, an energy storage medium, and an illumination grid connected together by electrical trace or wire; and an optical switching element connected to the tracing or wiring between the energy storage medium and the illumination grid;

wherein the positionally opposed lighting modules are each connected by screws to a center dowel placed into an opening in the side bar, interfacing ends of the lighting module housings pressing against the opposing sides of the sign bar.

2. The sign board lighting assembly of claim 1, wherein the optical switching element is operable according to an optically detected threshold level of ambient natural light to open and to close a circuit in the tracing or wiring between the energy storage medium and the illumination grid.

3. The sign board lighting assembly of claim 1, wherein the sign bar is supported by at least one vertical post and extends orthogonally from the vertical post or posts.

4. The sign board lighting assembly of claim 1, wherein the sign board is connected to a bottom end of the sign bar by eye bolts screwed into the bottom of the sign bar, the sign board hanging from the hook portions of the eye bolts.

5. The sign board lighting assembly of claim 1, wherein the solar collection array is a solar panel.

6. The sign board lighting assembly of claim 1, wherein the energy storage medium is a battery pack.

7. The sign board lighting assembly of claim 1, wherein the illumination grid is a grid of light emitting diodes (LED).

8. The sign board lighting assembly of claim 1, wherein the solar collection array and the illumination grid are held parallel in separate planes by the housing.

9. The sign board lighting assembly of claim 1, wherein the solar collection array and or the illumination grid are held at angles offset from 180 degrees.

10. The sign board lighting assembly of claim 9, wherein the solar collation array and or the illumination grid are angularly adjustable away from 180 degrees.

11. The sign board lighting assembly of claim 1, wherein the solar powered lighting modules each further including a pane of light diffusing glass installed over the illumination grid.

* * * * *